US005297408A

United States Patent [19]

Yoshida

[11] Patent Number: 5,297,408

[45] Date of Patent: Mar. 29, 1994

[54] METHOD OF AN APPARATUS FOR CONTROLLING HYDRAULIC ROLLING REDUCTION IN A ROLLING MILL

[76] Inventor: Keiichiro Yoshida, 497, Shimonagayoshi, Mobara, Chiba, Japan

[21] Appl. No.: 817,693

[22] Filed: Jan. 7, 1992

[30] Foreign Application Priority Data

Feb. 19, 1991 [JP] Japan ..... 3-046184
Nov. 21, 1991 [JP] Japan ..... 3-332582

[51] Int. Cl.[5] ..... B21B 37/08
[52] U.S. Cl. ..... 72/16; 72/245
[58] Field of Search ..... 72/16, 21, 245, 20, 72/241.6, 248

[56] References Cited

U.S. PATENT DOCUMENTS 3,389,588 3/1965 Reinhardt et al. ..... 72/8
3,570,288 3/1971 Fischer et al. ..... 72/21
3,686,907 8/1972 Sokolov et al. ..... 72/21
3,974,672 8/1976 Herbst ..... 72/21

FOREIGN PATENT DOCUMENTS 2047733 4/1971 Fed. Rep. of Germany .
2536203 3/1976 Fed. Rep. of Germany .
3007042 9/1981 Fed. Rep. of Germany .
0141306 11/1980 Japan ..... 72/21
58-23162 5/1983 Japan .
59-50407 12/1984 Japan .
61-13885 4/1986 Japan .
0077112 4/1987 Japan ..... 72/245
0154811 6/1989 Japan ..... 72/245
0774635 10/1980 U.S.S.R. ..... 72/245

*Primary Examiner*—Lowell A. Larson
*Assistant Examiner*—Thomas C. Schoeffler
*Attorney, Agent, or Firm*—Wenderoth, Lind & Ponack

[57] ABSTRACT

The method and apparatus are provided for controlling the gap between the rolls by comparing the initial gap setting and the actual gap value and providing the quantity of hydraulic fluid for the hydraulic rolling reduction cylinder in response to the output of the comparison.

The method consists of setting the value for the gap between the rolls, measuring the actual gap, comparing the gap setting value and the actual gap value, controlling the quantity of hydraulic fluid to be supplied to the rolling reduction cylinder in response to any deviation between the two values, and thereby controlling the rolling reduction for the cylinder.

The apparatus includes means for setting the value for the gap between the rolls, means for measuring the actual gap, means for comparing the gap setting value and the actual gap value, means for controlling the flows of hydraulic fluid to be supplied to the hydraulic rolling reduction cylinder in response to the output of the comparator means so that one flow can occur in one direction and the other flow can occur in the opposite direction, said flow controlling means being connected in parallel for providing the hydraulic fluid for the cylinder.

16 Claims, 5 Drawing Sheets

METHOD OF AN APPARATUS FOR CONTROLLING HYDRAULIC ROLLING REDUCTION IN A ROLLING MILL

BACKGROUND OF THE INVENTION

1. Field of the Invention

The present invention relates to the control of hydraulic rolling reduction in a rolling mill, and more particularly to a method and apparatus that permit the gap between the rolls to be adjusted in accordance with the output that may be provided by comparing the actual value as measured against a specific value that is set for the gap between the rolls and determining any difference between the two values.

2. Description of the Prior Art

A hydraulic rolling reduction apparatus for the rolling mill is known. For one apparatus, it is disclosed that the rolling reduction for the rolls is controlled by using an elastic body that is interposed between a moving part in a sensor that detects the positions of the rolls and a hydraulically-operated cylinder that moves the sensor's moving part toward the moving part in the cylinder (Japan examined patent publication No. 58-23162). For another apparatus, it is disclosed that the gap between the rolls is controlled by a flow rate control loop in which the output gain from the flow rate control system can be maintained to be constant (Japan examined patent publication No. 61-13885). In this patent, the flow rate control loop includes a sensor that detects the flow rate for the hydraulic fluid, and a rate control circuit that responds to any deviation of the detection signal from a flow rate reference signal and provides an operating current reference signal for controlling the degree of opening of a servo valve. There is also an apparatus that includes an automatic leak compensation controller (Japan examined patent publication No. 59-50407). This patent discloses that the controller includes a means for setting the positions of the rolls, a means for sensing the positions of the rolls as set by the setting means, a integrator circuit that integrates any difference between the setting position and the output of the sensor means, a pulse generator, a pulse counter, a digital to analog (D/A) converter that converts the output of the pulse counter to a corresponding analog signal, a comparator that compares the output of the integrator and the output signal of the D/A converter, and a circuit means that generates an ADD pulse or SUBTRACT pulse in response to the output of the comparator to be added to the servo valve control signal.

The apparatus disclosed in the patents mentioned above are specifically designed for use in large scale applications, and have complicated mechanisms necessary to meet the requirements for those particular applications. It may be expected that each apparatus performs well in its own operating environment, but that the design is not such that it can also be used in medium or small scale applications. As such, they are not general-purpose controllers. Particularly, it is difficult for any apparatus to control the gap between the rolls with high precision (such as a precision of above 1/1000 mm) and easily, by moving a slight amount of hydraulic fluid. No apparatus that implements this conceptual architecture has yet been known.

SUMMARY OF THE INVENTION

The present invention solves the problems of the prior art as described above by providing means for controlling the rolling reduction between the rolls in a rolling mill that includes means for setting the gap between the rolls, means for measuring the actual gap, comparator means coupled to the setting means and to the measuring means for providing the result of the comparison, means for controlling the flow rates of the hydraulic fluid coupled to the output of the comparator means to provide two flows of hydraulic fluid so that one flow can occur in one direction and the other flow can occur in the opposite direction, in response to the output value from the comparator means, and fluid circuit means connected in parallel with the flow rate control means for feeding the hydraulic fluid to a hydraulic fluid rolling reduction cylinder.

The method according to the present invention includes setting the gap between the rolls, measuring the actual gap, comparing the setting gap value and the actual gap value and determining any deviation of the setting gap value from the actual gap value, and adjusting the gap in accordance with the output resulting from the comparison, wherein it further includes feeding the differential hydraulic fluid that is equal to the difference between the positive and negative fluid flows that may be determined from the output of the comparison. Practically, the differential hydraulic fluid equal to the difference between the positive and negative fluid flows may be obtained by causing the two hydraulic fluid flows to respectively flow toward and away from the hydraulic rolling reduction cylinder.

A variation of the method according to the present invention includes setting the gap between the rolls, measuring the actual gap, determining any deviation of the setting gap value from the actual gap value as well as any deviation of the specific thickness of the blank being rolled from the actual thickness value, and adjusting the gap according to the respective deviations, wherein it further includes feeding the differential hydraulic fluid that is equal to the difference between the positive and negative fluid flows that may be determined from those respective deviations. Again, the differential hydraulic fluid may be obtained by causing the two hydraulic fluid flows to respectively flow toward and away from the hydraulic rolling reduction cylinder.

In its preferred embodiment, the apparatus according to the present invention provides the rolling reduction control functions, and includes means for setting the gap between the rolls, means for measuring the actual gap, comparing the setting gap value and the actual gap value and determining any difference between those two values, and means for controlling two fluid flows to flow in parallel toward and away from the hydraulic fluid rolling reduction cylinder so that a single resultant flow can flow in either of two direction, depending upon the output of the comparator means. The means for measuring the actual gap may be implemented by the magnetically-actuated position detector, and the means for controlling the fluid flows may be implemented by the flow rate regulator valve.

The magnetically-actuated position detector (Magneto-Scale) that implements the gap measuring means includes two probes, one of which is disposed between the upper roll's bearing and the upper stand, and the other of which is disposed between the upper roll's bearing and a position midway up the machine pedestal.

The means for controlling the fluid flows includes two flow rate regulator valves. For one flow rate regulator valve, the hydraulic fluid circuit includes a constant flow delivery pump, a variable flow delivery pump whose inlet side is coupled with the outlet side of the constant flow delivery pump and whose outlet side is coupled with the hydraulic rolling reduction cylinder, and a flow rate controller connected to the output of the comparator that provides the difference between the gap setting value and the actual gap value. For the other flow rate regulator valve, the hydraulic fluid circuit includes a first fluid circuit including a constant revolution motor operably connected with a constant flow delivery pump and a second fluid circuit including a variable revolution motor operably connected with a variable flow delivery pump. The two fluid circuits are connected in parallel with each other, and the outlet of the constant flow delivery pump is coupled to the inlet of the variable flow delivery pump and to the hydraulic rolling reduction cylinder, and the inlet of the constant flow delivery pump and the outlet of the variable flow delivery pump are coupled to the hydraulic fluid supply source.

It may be appreciated that the present invention allows the two flow rate regulator valves to be used efficiently in terms of their respective capacities. The flow rates through those regulator valves can be controlled so that a differential hydraulic fluid (or resultant fluid flow) that is equal to the difference between the two flow rates can be provided. Thus, the differential hydraulic fluid to be supplied may be small, but its control can be provided accurately and efficiently.

The regulator valves may be replaced by the variable flow delivery pumps or the variable revolution motors which allow the respective delivery pumps to provide variable quantities of hydraulic fluid. These choices may depend upon the particular application requirements.

According to the present invention, the gap between the rolls can be controlled with a precision between 1/1000 mm and 5/1000 mm. In order to maintain the precision within this value range, it is important to consider the elasticity that the rolling stand may exhibit. The cast steel rolling stand may, for example, contain a different elastic strain for each of the upper and lower frames thereof when it is cast, and this difference must be corrected. If this correction is based on adjusting the difference in the elastic strain and is included in the calculation, the process becomes complicated, and involve many steps for implementation. The ability to adjust the height of points to be measured in correspondence to the difference in the elastic strain between the upper and lower frames of the rolling stand will provide an easier means to correct the difference, and can be practically implemented.

Specifically, measuring the gap between the rolls may be accomplished by measuring the gap between the rolling stand and the bearing for the upper roll. The height of the particular points of the rolling stand to be measured may be defined by measuring and determining the difference in the elastic strain that the upper and lower frames may contain. Theoretically, it can thus be assumed that the elastic strain for each of the right-side and left-side rolling stands (which may exhibit its effect) is essentially identical. For practical purposes, therefore, the elastic strain can be viewed as the gap between the bearings that support the upper and lower rolls (specifically, the magnitude of the gap between the rolls), respectively.

It may be appreciated from the preceding description that the present invention includes setting the gap between the rolls, measuring the actual gap, comparing the two valves to determine the difference between the values, and actuating the two flow rate regulator valves in response to the result of the comparison to provide the differential hydraulic fluid (i.e. the resultant fluid flow) toward or away from the hydraulic rolling reduction cylinder by way of their respective hydraulic fluid circuits connected in parallel. Thus, the quantity of hydraulic fluid to be supplied can be fine-adjusted accurately and efficiently, and the rolling precision can be enhanced.

As adequate differential hydraulic fluid can be provided by the two flow rate regulator valves, those regulators can be used most efficiently in terms of their respective capacities.

As it may be appreciated from the foregoing description, the gap between the rolls may initially be specified, and the initial gap value may be compared with the actual gap value so that the difference between the two values can be determined. In response to this difference, the differential hydraulic fluid (i.e. resultant fluid flow) can be obtained from the combination of the two flow rate regulator valves connected in parallel, and can be delivered to or removed from the hydraulic rolling reduction cylinder. The quantity of hydraulic fluid to be delivered can be controlled with high precision, and the thickness of a blank being rolled can therefore be controlled with high precision. This can proceed in a continuous manner. The thickness of a blank being rolled can be controlled with higher precision by including the measured values for the elastic strains in the rolling stand frames in the above calculation. In this case, the precision of the rolling thickness precision of above 3/1000 mm can be achieved.

BRIEF DESCRIPTION OF THE DRAWINGS

Those and other objects, features, and advantages of the present invention may be understood from the following detailed description of the preferred embodiments that will be provided by referring to the accompanying drawings, in which.

DETAILED DESCRIPTION OF THE PREFERRED EMBODIMENTS

The following description is provided with reference to several preferred embodiments of the present invention.

EXAMPLE 1

Figure 1:
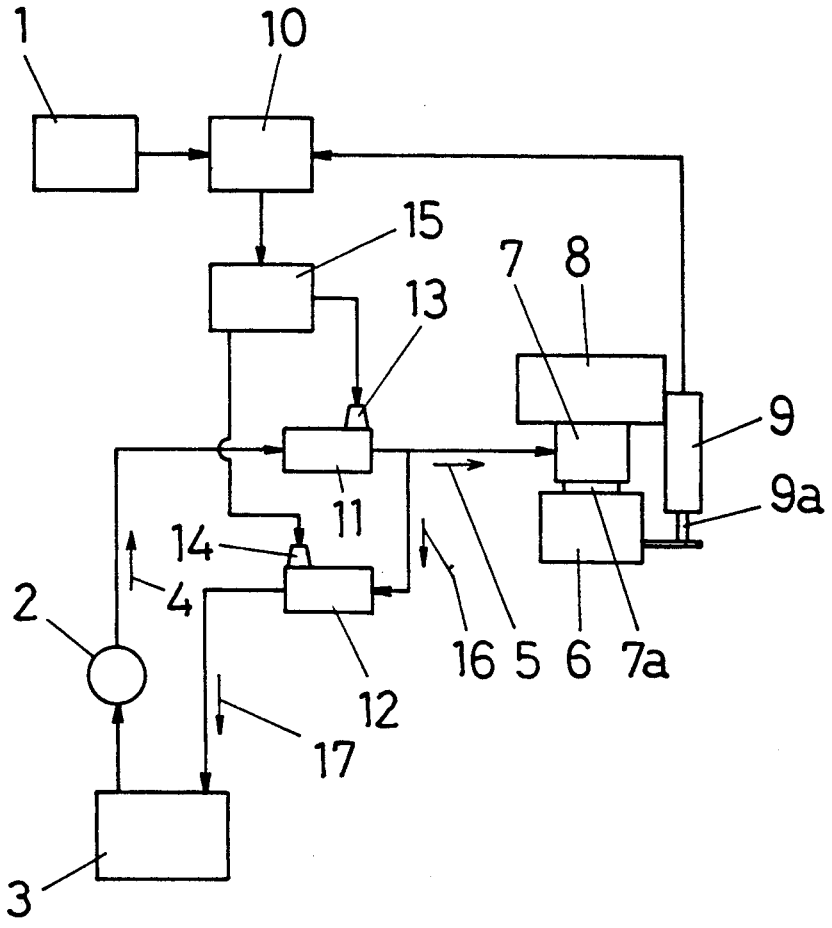
FIG. 1 is a block diagram illustrating a rolling reduction control system configuration according to one preferred embodiment of the present invention.

By referring first to FIG. 1, a process of controlling the rolling reduction for the hydraulically-operated rolls in the rolling mill will now be described.

Initially, a gap between the rolls may be specified by a setter 1. Then, a hydraulic pump 2 is started up. When it is operational, the hydraulic pump 2 draws the hydraulic fluid from a hydraulic fluid supply source 3, delivering it to a hydraulic rolling reduction cylinder 7 above a bearing 6 supporting the upper roll, as indicated by arrows 4, 5. A magnetically-actuated position sensor 9 which is secured to a roll stand 8 is sensitive to any change in the position of the bearing 6 for the upper roll, and provides output which is connected to the input of a comparator 10 which is also coupled to the output of the gap setter 1. The comparator 10 compares the gap value as specified by the setter 1 and the actual gap value from the sensor 9, and provides output to a pulse controller 15. In response to the output from the comparator 10, the pulse controller 15 provides an output pulse which is applied to each respective stepping motor 13, 14 for each flow rate control valve 11, 12 for the hydraulic fluid. Each of the stepping motors 13, 14 provides an indexing motion that corresponds to the magnitude of the respective input pulse, and actuates each respective flow rate control valve 11, 12 to open to such a degree that they can allow the appropriate differential hydraulic fluid to be supplied to the hydraulic rolling reduction cylinder. Thus, this can occur accurately. The flow rate control valve 11 allows the hydraulic fluid to flow as indicated by arrows 4, 5, while the flow rate control valve 12 allows the hydraulic fluid to flow as indicated by arrows 16, 17. When it is necessary to reduce the existing gap between the rolls and the corresponding signal is received, the flow rate control valve 11 is actuated to allow more hydraulic fluid to flow therethrough than the flow rate control valve 12, causing the ram 7*a* for the hydraulic fluid rolling reduction cylinder 7 to be lowered. Conversely, when it is necessary to increase the existing gap between the rolls and the corresponding signal is received, the flow rate control valve 12 is actuated to allow more hydraulic fluid to flow therethrough than the flow rate control valve 11 and part of the hydraulic fluid within the rolling reduction cylinder 7 is returned to the hydraulic fluid supply source 3 as indicated by arrows 16, 17. This removes the corresponding quantity of hydraulic fluid from the cylinder 7, causing its ram 7*a* to be raised.

It may be appreciated from the above description that the quantity of hydraulic fluid to be supplied to the hydraulic rolling reduction cylinder 7 may be controlled by enabling the two flow rate control valves 11, 12 to open to a degree necessary meet specific requirements. Thus, the two control valves can be used in such way that their respective capacities can be utilized most efficiently, and the thickness to which a blank is rolled can be controlled with higher precision.

EXAMPLE 2

Figure 2:
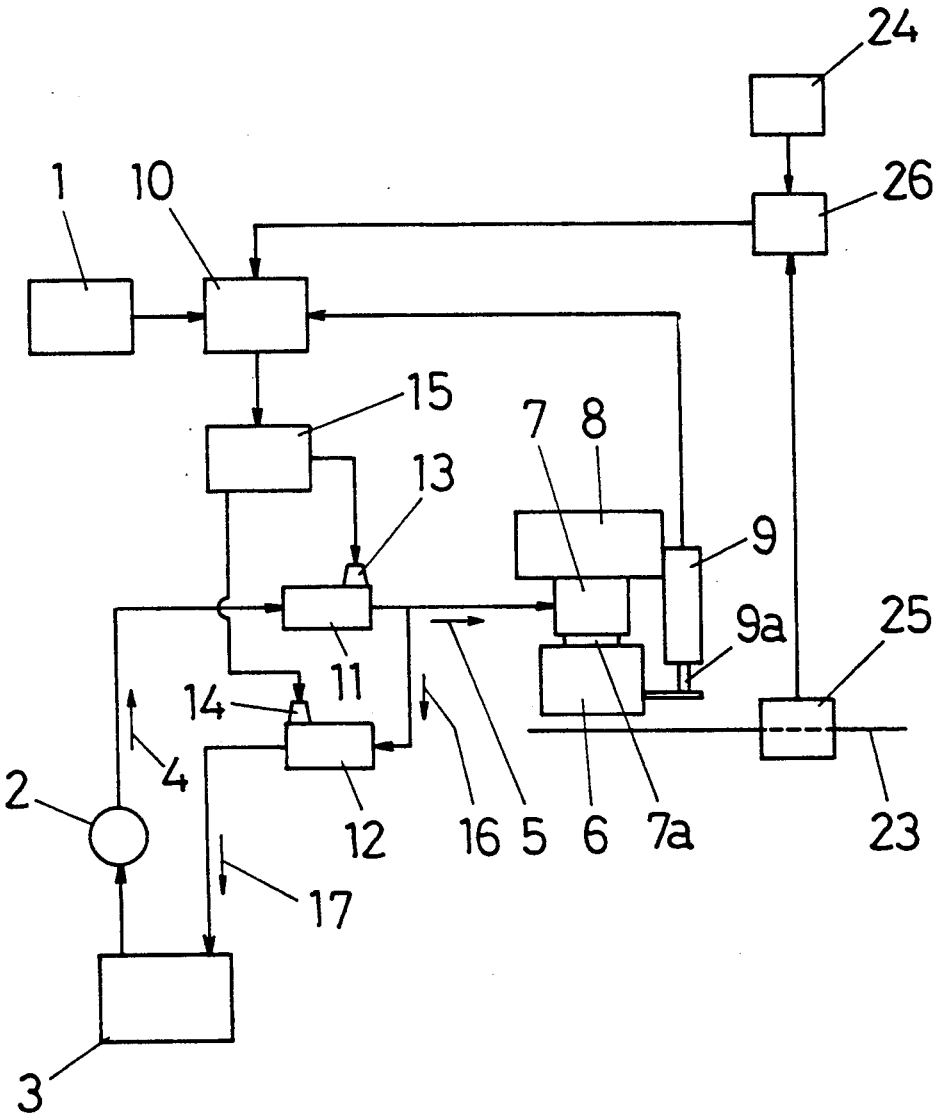
FIG. 2 is a block diagram illustrating a rolling reduction control system configuration according to another preferred embodiment.

The embodiment shown in FIG. 2 includes a step of measuring, at a given point in time the thickness of the blank 23 that has been rolled according to the steps in the previous embodiment. The process consists of comparing the value as specified by the thickness setter 24 and the actual value as measured by the detector 25 (as implemented by a comparator 26). The output of the comparator 26 is applied to a further comparator 10. The functions of the comparator 10 and other hardware elements as well as their arrangements have been described with reference to the preceding example, and therefore description thereof will not be provided again to avoid duplication.

EXAMPLE 3

Figure 3:
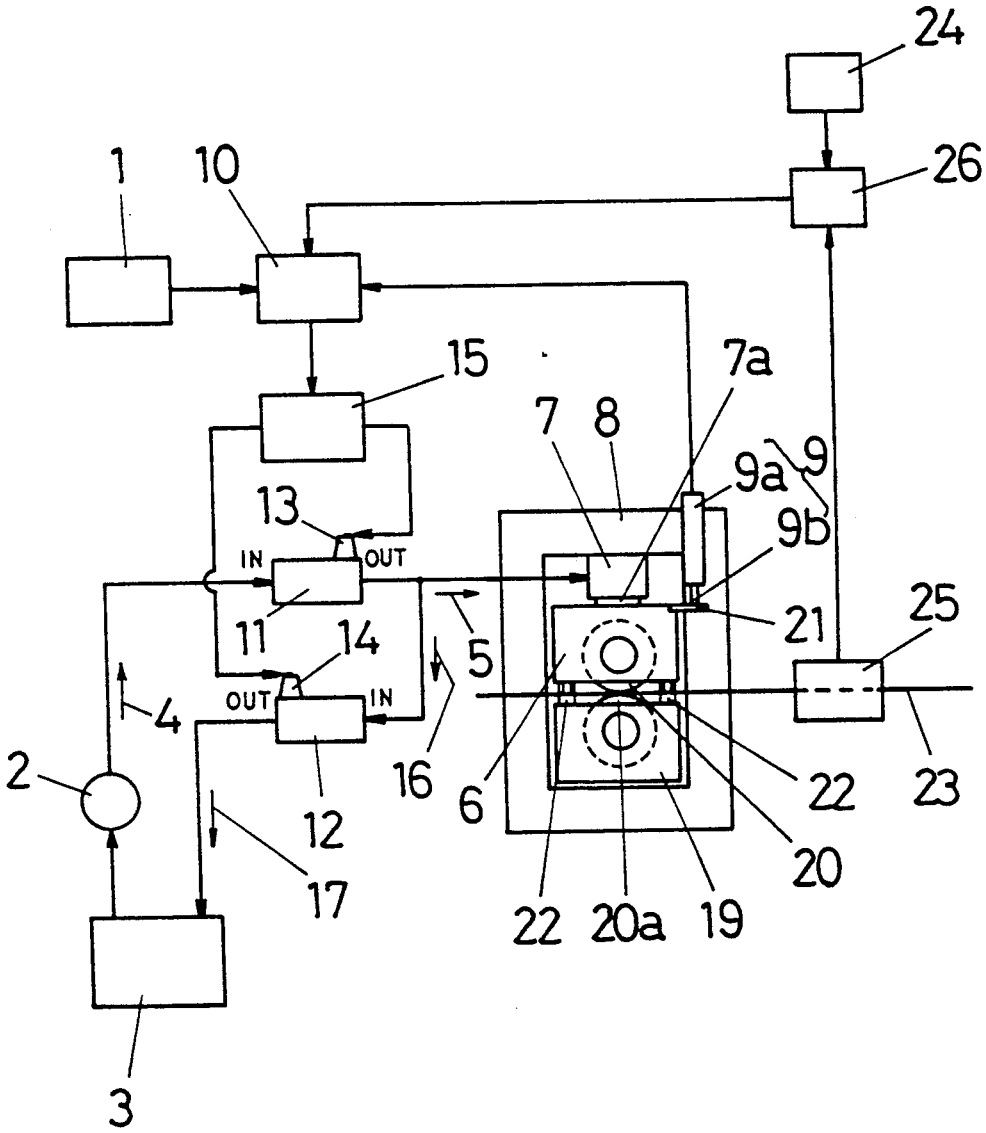
FIG. 3 is a block diagram illustrating the rolling reduction control system configuration including rolls in a rolling mill.

Referring next to FIG. 3, the rolling mill facility to which the present invention may be applied will now be described.

As seen from FIG. 3, the rolling mill facility includes a rolling stand 8 within which rolls 20, 20*a* are mounted. The roll 20 is supported by a bearing 6, and a hydraulic fluid rolling reduction cylinder 7 is mounted between the bearing 6 and the rolling stand 8. The rolling stand 8 includes a magnetically-actuated position detector 9*a* affixed to on one side thereof. The detector 9*a* has a probe 9*b* which makes contact with a projection 21 on the bearing 6. Counter-action cylinders 22, 22 are provided between the bearing 6 and the bearing 19 for the roll 20*a*. Those counter-action cylinders 22, 22 provide an action for maintaining the gap between the rolls in equilibrium under no load conditions.

In operation, a particular gap between the rolls is initially specified by using the gap setter 1, and the hydraulic pump 2 is started up. The hydraulic fluid is then delivered from the pump 2 to the flow rate control valves 11, 12 which control how far the ram 7*a* should be projecting. Then, a blank 23 to be rolled is fed between the rolls. As the blank 23 is being fed, the gap between the rolls will change. This change is detected by the magnetically-actuated position detector 9. The output of the detector 9 is applied to the comparator 10 to which the initial setting value is also applied. If it is determined that there is any change between the initial setting and the actual value, the output of the comparator 10 that represents the difference is applied to the pulse controller 15 which provides the corresponding pulse signal. This pulse signal is applied to each of the stepping motors 13, 14 which provides the respective indexing motion which actuates each respective flow rate control valve 11, 12 to open to a degree that depends upon the magnitude of the indexing motion of the respective stepping motors 13, 14. The quantity of hydraulic fluid through each respective control valve 11, 12 is determined by the degree of opening. The hydraulic fluid rolling reduction cylinder 7 may be controlled by changing (increasing or decreasing) the relative quantities of hydraulic fluid that can be allowed to flow through the control valves 11, 12 and supplying the differential hydraulic fluid to the cylinder 7. The gap between the rolls can be maintained constant at all times, and a high rolling precision can be provided accordingly. It is possible that the rolls 20, 20*a* may thermally expand thereby making the gap smaller. If this occurs, the blank 23 being rolled will become thinner. This change in the gap may be detected by the detector 25 immediately, and can be removed by correcting the initial setting in accordance with the output from the detector 25.

The precision of the thickness that may depend upon the thickness of a particular blank to be rolled as well as the precision of the thickness that may depend upon the thermal expansion of the rolls or any other factors that may affect the precision can be controlled so that the resulting product can have high quality.

EXAMPLE 4

Figure 4:
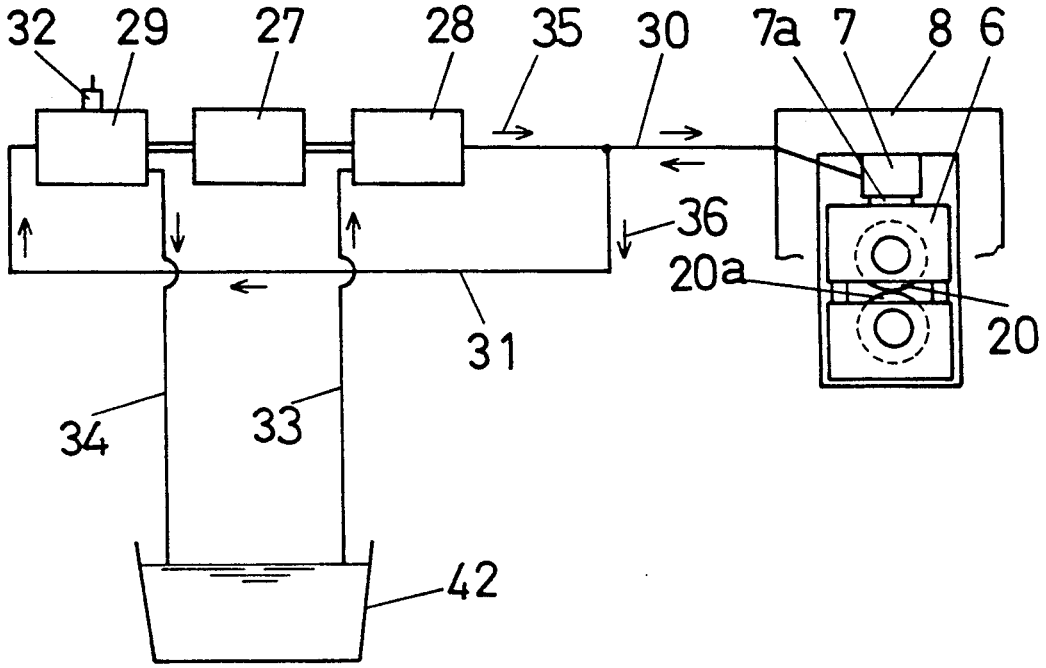
FIG. 4 is a block diagram illustrating a rolling reduction control system configuration including rolls in a rolling mill and a variable delivery pump.

Referring next to FIG. 4, an embodiment will be described in which the quantity of hydraulic fluid to be supplied is controlled.

In the embodiment shown in FIG. 4, a rolling stand 8 includes rolls 20, 20*a*. The roll 20 is supported by a bearing 6. A hydraulic fluid rolling reduction cylinder 7 is provided between the bearing 6 and the rolling stand 8. The hydraulic fluid circuit includes a motor 27, a constant fluid delivery pump 28 coupled with one end of the motor shaft, and a variable fluid delivery pump 29 coupled with the opposite end of the motor shaft. The outlet of the constant fluid delivery pump 28 is connected to an outlet conduit 30, which is coupled with the inlet conduit 31 from the variable fluid delivery pump 29. The variable fluid delivery pump 29 also has a controller 32 which is coupled with the output of a detector which responds to any change in the gap for providing output of the actual gap value. The hydraulic fluid circuit further includes an inlet conduit 33 coupled with the constant fluid delivery pump 28, an outlet conduit 34 coupled with the variable fluid delivery pump 29, and a hydraulic fluid supply source 42.

In operation, the motor 27 drives the two pumps 28 and 29. The constant fluid delivery pump 28 delivers a hydraulic fluid at a constant rate which flows through the outlet conduit 30 as indicated by an arrow 35, while the variable fluid delivery pump 29 accepts a hydraulic fluid through the inlet conduit 31 as indicated by an arrow 36. When the quantity of hydraulic fluid going out of the pump 28 into the outlet conduit 30 and the quantity of hydraulic fluid entering the pump 29 from the inlet conduit 31 are equal, the ram 7*a* in the rolling reduction cylinder 7 is placed in its current position. Then, if the actual gap between the rolls 20, 20*a* is found to be larger than the initial setting, such is detected by the detector which provides output to be fed to the controller 32 on the variable fluid delivery pump 29. In response to the output from the controller 32, the quantity of hydraulic fluid that enters the variable fluid delivery pump 29 decreases. The resulting differential fluid that is equal to the difference between the output from the pump 28 and the input to the pump 29 is delivered to the rolling reduction cylinder 7 which is actuated so that the gap between the rolls 20, 20*a* can be reduced accordingly.

Conversely, if the actual gap is found to be smaller than the initial setting, the quantity of hydraulic fluid entering the variable fluid delivery pump 29 should be controlled to be more than the quantity of hydraulic fluid leaving the constant fluid delivery pump 28 (which is also controlled by the controller 32). Then, the quantity of hydraulic fluid that resides in the cylinder 7 may be decreased by the difference between the input to the pump 29 and the output from the pump 28. The rolling reduction may result, increasing the gap between the rolls accordingly.

As described earlier, the embodiment shown in FIG. 4 also allows the difference between the initial gap setting and the actual gap value to be determined. This difference may be converted to the control signal which controls the variable fluid delivery pump 29, thereby fine-adjusting the gap between rolls.

EXAMPLE 5

Figure 5:
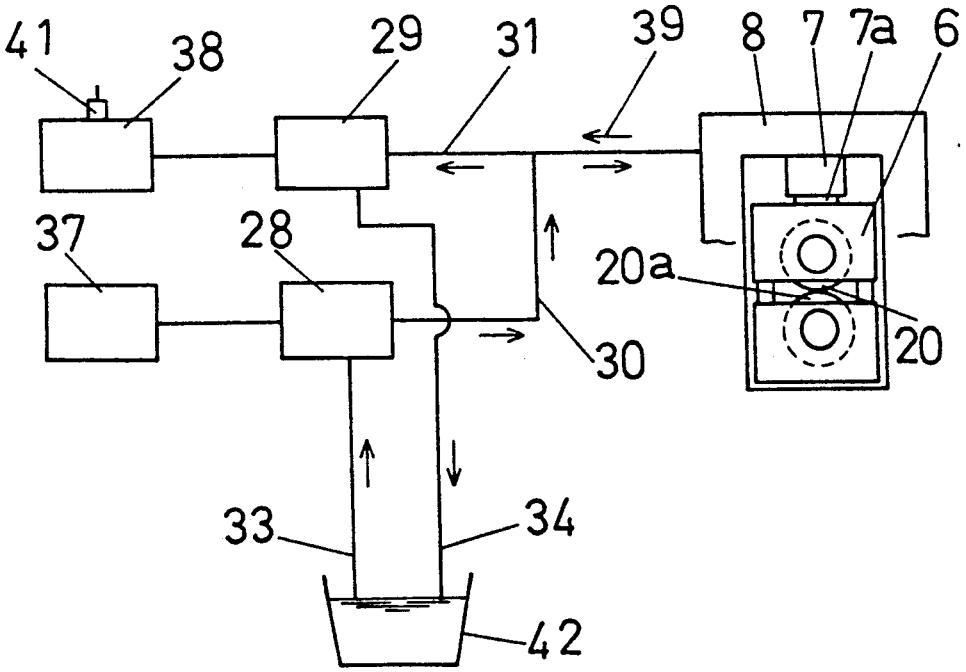
FIG. 5 is the block diagram illustrating the rolling reduction control system configuration including rolls in a rolling mill and a variable-speed motor.

Another embodiment is shown in FIG. 5. The control of the hydraulic fluid being supplied according to this embodiment will now be described.

Rolls 20, 20*a* are mounted within a rolling stand 8. The roll 20 is supported by a bearing 6. A hydraulic fluid rolling reduction cylinder 7 is provided between the bearing 6 and the rolling stand 8.

The hydraulic fluid circuit includes a constant revolution motor 37, a constant fluid delivery pump 28 driven by the motor 37, a variable revolution motor 38, and a variable fluid delivery pump 29 driven by the motor 38. The hydraulic fluid to be supplied to the rolling reduction cylinder may be increased or decreased as described below.

The outlet of the constant fluid delivery pump 28 is connected with an outlet conduit 30 which is coupled with the inlet conduit 31 connected with the inlet of the variable fluid delivery pump 29, as described in the example 4.

In operation, if it is found that the actual gap between the rolls 20, 20*a* is smaller than the initial setting, the detector responds to this change and provides output which is applied to a controller 41. The variable motor 38 may be controlled so that it provides more revolutions, causing the variable fluid delivery pump 29 to draw more hydraulic fluid. Then, part of the hydraulic fluid that resides within the rolling reduction cylinder 7 will be removed through the outlet conduit 30 as indicated by an arrow 39. Thus, the force of the cylinder upon the roll 20 will be decreased, and the roll 20 is raised accordingly. Then, the original gap is restored as required.

Conversely, if it is found that the actual gap between the rolls 20, 20*a* is greater than the initial setting, the original value is applied to the controller 41 which operates to slow the variable motor 38. In this case, the quantity of hydraulic fluid drawn by the variable fluid delivery pump 29 will be smaller than the quantity of hydraulic fluid delivered by the constant fluid delivery pump 28, the differential fluid being delivered to the rolling reduction cylinder 7 as indicated by an arrow 40. Then, the roll 20 is lowered, and the original gap is restored.

It may be understood that the gap between the rolls 20, 20*a* can be maintained as required by the original setting, by controlling the variable motor to allow the variable fluid delivery pump to provide the appropriate quantity of hydraulic fluid to be supplied to the rolling reduction cylinder 7.

EXAMPLE 6

Figure 6:
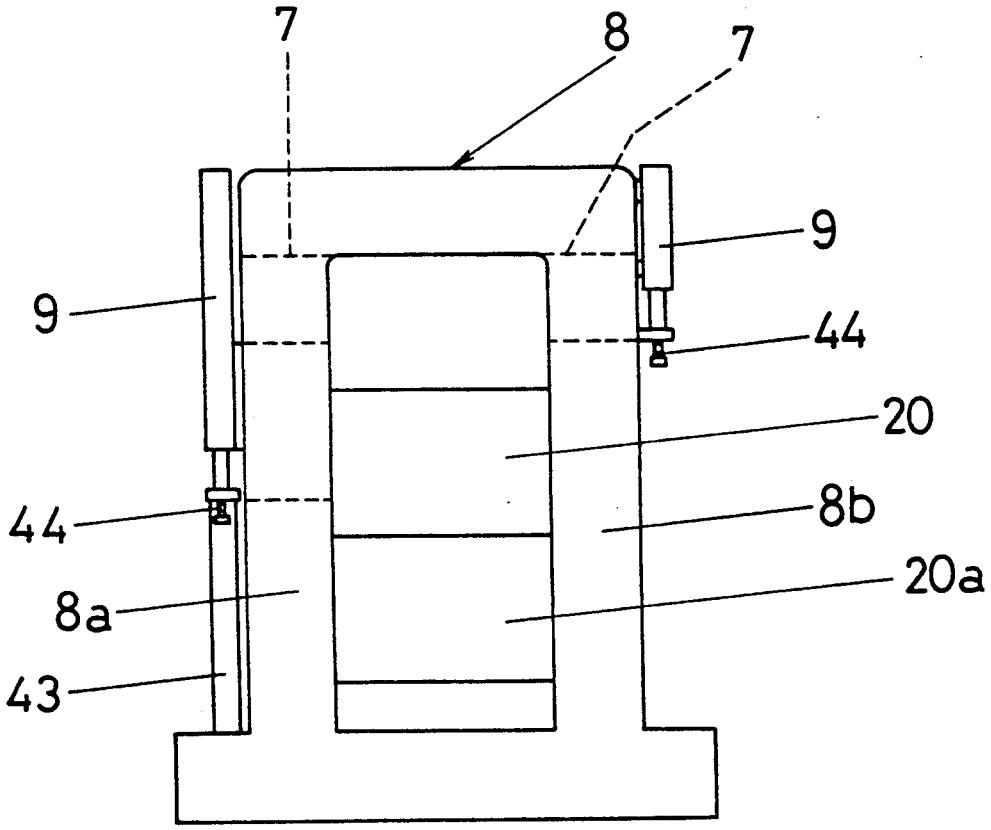
FIG. 6 is the side elevation illustrating parts of the rolls in the rolling mill with a magnetically-actuated position detector installed.

Referring next to FIG. 6, there is shown an embodiment that takes into account the presence of any elastic strain in each of the frames 8*a* and 8*b* that make up the cast steel rolling stand 8.

For the cast steel rolling stand 8, it is usual that the frames 8*a* and 8*b* contain a different elastic strain. This is because when the casting occurs with the frame 8*b* located below the frame 8*a*, the frame 8*b* will have a metal structure whose density is greater than the frame 8*a*, and therefore will contain less elastic strain. Accordingly, for the frame 8*b*, a magnetically-actuated position sensor 9 may be provided between the bearing for the roll 20 and the upper portion of the frame 8*b* in such a manner that the value measured by the sensor 9 includes any elastic strain along the total length of the frame 8*b*.

For the frame 8*a*, on the other hand, a magnetically-actuated position sensor 9 may be provided between the bearing for the roll 20, and a probe 43 provided on the rolling stand 8 and extending up to the middle of the height of the rolling stand (as shown in FIG. 6). The measurement with respect to the frame 8*a* is conducted by the sensor 9 between the top of the probe 43 and the upper portion of the rolling stand 8 (where it abuts against the rolling reduction cylinder). Thus, the value measured by the sensor 9 includes any elastic strain along the length of frame 8*a* between the point at the top of the probe 43 and the upper portion of the rolling stand 8. In this way, for the frame 8*b*, any elastic strain along the total length is included in the value measured by the sensor 9, and for the frame 8*a*, any elastic strain from the point of the top of the probe 43 to the upper portion of the rolling stand 8 (where it abuts against the rolling reduction cylinder) is included in the measured by the sensor 9 value. The amount of elastic strain for a given length is constant, and it is therefore possible to assume that the amounts of elastic strain at the particular points to be measured for the frames 8*a* and 8*b* are equal, by determining the elastic strain properties for both frames 8*a* and 8*b* previously and setting the sensors 9, 9 at heights on the frames 8*a* and 8*b* which reflect the difference in the elastic strain between the frames 8*a* and 8*b*. In the figure, reference numeral 44 designates a micro-adjusting screw.

The micro-adjusting screw 44 allows the operator to fine-adjust the thickness of a blank across its width (i.e., in the direction perpendicular to the traveling path) by monitoring the travel of the blank being rolled and by checking to see the light beams reflected from the blank. The micro-adjusting screw advances or retracts by 1/100 mm for one complete turn. The gap between the rolls, which is an input to the controller, may be adjusted by depressing the appropriate button on the keyboard. Each depression of the button adjusts the gap by one micron. For some types of blanks being rolled, using the micro-adjusting screw (analog operation) is better than using the button (digital operation). The micro-adjusting screw may be used for those blanks which have a wide elastic deformation range (such as a stainless blank), but the choice may depend upon the sensibility of the operator.

Although the present invention has been described in full detail by referring to the several particular preferred embodiments thereof, it should be understood that various changes and modifications may be made without departing from the spirit and scope of the invention as defined in the appended claims.

What is claimed is:

1. A control apparatus for controlling a gap between opposing rolls of a rolling mill, comprising:

a hydraulic cylinder means operably coupled to at least one of the opposing rolls of the rolling mill for adjustably maintaining the gap between the opposing rolls;

a hydraulic fluid supply;

a first fluid control means for causing hydraulic fluid to flow from said hydraulic fluid supply in a first flow path toward said hydraulic cylinder means;

a second fluid control means for causing hydraulic fluid to flow to said hydraulic fluid supply in a second flow path away from said hydraulic cylinder means; and means for combining the fluid flow in said first flow path with the fluid flow in said second flow path to obtain a resultant fluid flow, and for applying said resultant fluid flow to said hydraulic cylinder means such that hydraulic fluid is supplied to said hydraulic cylinder means when the fluid flow in said first flow path is greater than the fluid flow in said second flow path and such that hydraulic fluid is removed from said hydraulic cylinder means when the fluid flow in said second flow path is greater than the fluid flow in said first flow path.

2. A control apparatus as recited in claim 1, wherein said first fluid control means comprises a hydraulic pump and a first flow rate regulator valve fluidically connected in series in said first flow path;

said second fluid control means comprises a second flow rate regulator valve fluidically connected in said second flow path; and said second flow rate regulator valve is fluidically connected in parallel with said first flow rate regulator valve.

3. A control apparatus as recited in claim 1, wherein said first fluid control means comprises a first fluid delivery pump fluidically connected in said first flow path;

said second fluid control means comprises a second fluid delivery pump fluidically connected in said second flow path;

said first fluid delivery pump is fluidically connected in parallel with said second fluid delivery pump; and one of said first and second fluid delivery pumps is a constant delivery rate pump, and the other of said first and second fluid delivery pumps is a variable delivery rate pump.

4. A control apparatus as recited in claim 3, further comprising a motor; and wherein both of said first and second fluid delivery pumps are drivingly connected to said motor.

5. A control apparatus as recited in claim 3, further comprising a constant speed motor drivingly connected to said constant delivery rate pump; and a variable speed motor drivingly connected to said variable delivery rate pump.

6. A control apparatus as recited in claim 1, wherein said first fluid control means comprises a first fluid delivery pump fluidically connected in said first flow path;

said second fluid control means comprises a second fluid delivery pump fluidically connected in said second flow path;

said first fluid delivery pump is fluidically connected in parallel with said second fluid delivery pump; and said first fluid delivery pump is a constant delivery rate pump, and said second fluid delivery pump is a variable delivery rate pump.

7. A control apparatus as recited in claim 1, further comprising gap measuring means for measuring the gap between the opposing rolls;

comparing means for comparing the gap as measured by said gap measuring means with a predetermined target gap; and wherein said first and second fluid control means are operable to regulate the fluid flow in said first and second flow paths, respectively, in dependence on an output from said comparing means.

8. A control apparatus as recited in claim 7, further comprising thickness detecting means for detecting a thickness of a rolled blank output from between the opposing rolls of the rolling mill;

thickness comparing means for comparing the thickness detected by said thickness detecting means with a predetermined target thickness; and wherein said first and second fluid control means are further operable to regulate the fluid flow in said first and second flow paths, respectively, in dependence on an output from said thickness comparing means.

9. A method for controlling a gap between opposing rolls of a rolling mill, comprising:

operably coupling a hydraulic cylinder to at least one of the opposing rolls of the rolling mill for adjustably maintaining the gap between the opposing rolls;

providing a hydraulic fluid supply;

causing hydraulic fluid to flow from said hydraulic fluid supply in a first flow path toward said hydraulic cylinder;

causing hydraulic fluid to flow to said hydraulic fluid supply in a second flow path away from said hydraulic cylinder; and combining the fluid flow in said first flow path with the fluid flow in said second flow path to obtain a resultant fluid flow, and applying said resultant fluid flow to said hydraulic cylinder such that hydraulic fluid is supplied to said hydraulic cylinder when the fluid flow in said first flow path is greater than the fluid flow in said second flow path and such that hydraulic fluid is removed from said hydraulic cylinder when the fluid flow in said second flow path is greater than the fluid flow in said first flow path.

10. A method as recited in claim 9, wherein causing hydraulic fluid to flow from said hydraulic fluid supply in said first flow path toward said hydraulic cylinder comprises providing a hydraulic pump and a first flow rate regulator valve fluidically connected in series in said first flow path; and causing hydraulic fluid to flow to said hydraulic fluid supply in said second flow path away from said hydraulic cylinder comprises providing a second flow rate regulator valve fluidically connected in said second flow path, such that said second flow rate regulator valve is fluidically connected in parallel with said first flow rate regulator valve.

11. A method as recited in claim 9, wherein causing hydraulic fluid to flow from said hydraulic fluid supply in said first flow path toward said hydraulic cylinder comprises providing a first fluid delivery pump fluidically connected in said flow path;

causing hydraulic fluid to flow to said hydraulic fluid supply in said second flow path away from said hydraulic cylinder comprises providing a second fluid delivery pump fluidically connected in said second flow path, such that said first fluid delivery pump is fluidically connected in parallel with said second fluid delivery pump; and one of said first and second fluid delivery pumps is a constant delivery rate pump, and the other of said first and second fluid delivery pumps is a variable delivery rate pump.

12. A method as recited in claim 11, further comprising providing a motor; and drivingly connecting both of said first and second fluid delivery pumps to said motor.

13. A method as recited in claim 11, further comprising drivingly connecting a constant speed motor to said constant delivery rate pump; and drivingly connecting a variable speed motor to said variable delivery rate pump.

14. A method as recited in claim 9, wherein causing hydraulic fluid to flow from said hydraulic fluid supply in said first flow path toward said hydraulic cylinder comprises providing a first fluid delivery pump fluidically connected in said first flow path;

causing hydraulic fluid to flow to said hydraulic fluid supply in said second flow path away from said hydraulic cylinder comprises providing a second fluid delivery pump fluidically connected in said second flow path, such that said first fluid delivery pump is fluidically connected in parallel with said second fluid delivery pump; and said first fluid delivery pump is a constant delivery rate pump, and said second fluid delivery pump is a variable delivery rate pump.

15. A method as recited in claim 9, further comprising measuring the gap between the opposing rolls;

comparing the gap as measured with a predetermined target gap to obtain a gap comparison; and regulating the fluid flow in said first and second flow paths in dependence on said gap comparison.

16. A method as recited in claim 15, further comprising detecting a thickness of a rolled blank output from between the opposing rolls of the rolling mill;

comparing the thickness detected with a predetermined target thickness to obtain a thickness comparison; and further regulating the fluid flow in said first and second flow paths in dependence on said thickness comparison.

* * * * *